United States Patent [19]

Goeden

[11] Patent Number: 4,746,560

[45] Date of Patent: May 24, 1988

[54] DECORATIVE COMPOSITE PANEL

[75] Inventor: Herbert A. Goeden, Solon, Ohio

[73] Assignee: The Glastic Company, Cleveland, Ohio

[21] Appl. No.: 932,928

[22] Filed: Nov. 19, 1986

[51] Int. Cl.[4] ..... A63D 1/04

[52] U.S. Cl. ..... 428/151; 156/60; 156/307.1; 428/203; 428/210; 428/211; 428/212; 428/218; 428/251; 428/285; 428/430; 428/480

[58] Field of Search ..... 428/151, 203, 210, 211, 428/212, 218, 251, 285, 430, 480; 156/60, 307.1

[56] References Cited

U.S. PATENT DOCUMENTS

| | | | |
|---|---|---|---|
| 4,231,573 | 11/1980 | Kelly | 428/204 |
| 4,337,290 | 6/1982 | Kelly et al. | 428/203 |
| 4,599,124 | 7/1986 | Kelly et al. | 428/203 |

*Primary Examiner*—Marion C. McCamish

*Attorney, Agent, or Firm*—D. Peter Hochberg; Mark M. Kusner; Walter C. Danison, Jr.

[57] ABSTRACT

A decorative synthetic composite panel having a reinforced base portion comprised of a plurality of layers of fiber glass mat impregnated with a polyester resin, an overlying resin impregnated graphic print sheet, and a transparent resin overlay.

20 Claims, No Drawings

DECORATIVE COMPOSITE PANEL

FIELD OF THE INVENTION

The present invention relates to surface coverings, and more particularly to a fiber glass-reinforced molded panel composite. The present invention is particularly applicable to floor surfaces requiring high impact and wear resistance and will be described with reference thereto although the invention has other decorative flooring applications as well as applications as a wall covering.

BACKGROUND OF THE INVENTION

The present invention pertains to a decorative composite panel for use as a floor or wall member. In recent years, the use of natural material such has hardwood, marble, slate or mosaic tiles has become especially popular on floors and walls because of the luxurious appearance and because of the connotation of quality generally associated with such materials. These materials however are generally quite expensive and the installation very time consuming. Attempts have been made to produce a decorative surface coverings of synthetic materials such as plastics and resins to substitute for the most costly aforementioned materials.

For example, U.S. Pat. Nos. 4,139,671 and 4,337,290, to Kelly et al disclose synthetic laminate surfaces with woodgrain graphics for use in resurfacing worn wooden bowling lanes. These surfaces are generally comprised of layers of fiber glass cloth impregnated with a thermosetting resin. The laminates however are relatively thin, i.e., approximately 0.141 inches in thickness, and require a substrate to which it is attached, generally by means of adhesive. A problem associated with such structures is separation of the laminate surface from the substrate. Separation can result from temperature variations which effects the different coefficients of thermal expansion of the different layers, or from moisture absorption which causes the layers to flex at different rates causing separation and bulging. A heavy impact on a surface can also cause separation of the laminate from the substrate surface.

The present invention overcomes these and other problems by providing a decorative surface panel which is strong, wear and impact resistant, and easy to fabricate and install, which panel is of a sufficient thickness to be installed over floor joists or wall studs.

SUMMARY OF THE INVENTION

In accordance with the present invention there is provided a synthetic decorative composite panel comprised of a reinforced base portion having of a plurality of layers of fibrous mat impregnated with a polyester resin, an overlying graphic print sheet impregnated with a polyester resin, and transparent resin overlay, wherein the base portion, graphic print sheet and overlay form an integral molded composite.

More specifically, the reinforced base portion is comprised of a plurality of relatively thick fiberglass mats which form the core of the composite panel. These glass mats can best be described as thick pads of loosely intertwined or tangled strands of fiber glass. These mats which form the core have a specific fiber density, i.e., specific number of fibers per unit volume, and are formed from generally thick glass fibers. As compared to other glass mats included in the composite, these core mats can best be described as thick fiber/low density mats. These core mats are disposed between layers of thin fiber/high density mats which are generally thinner and more sheet-like than the coarse core mats. The mats forming the reinforced base portion are impregnated and saturated with a polyester resin. The printed graphic sheet overlaying the base portion provides the decorative image, such as an image of hard wood planks, to the composite. A transparent overlay is provided over the printed sheet to protect the graphic sheet. The overlay preferably includes a thin fiber/high density glass veil to reinforce the overlay. An unsaturated polyester impregnates the print sheet and glass veil and forms the wear coat overlay. The overall thickness of the panel is approximately ½".

The composite panel is formed by impregnating the graphic paper sheet with an unsaturated polyester resin and then coating the upper surface with a layer of the same or similar resin. A sheet of thin fiber/high density glass veil is placed on top of the resin impregnated and coated graphic sheet. Simultaneously, the layers of fiberglass mat forming the base portion are wetted (impregnated or saturated) with a mixture of polyester resin and a filler if necessary. The base mats are placed in a press with the print and veil placed on top. The press is closed at approximately 500 psi and 220° F. for 9 minutes. The result is a composite panel approximately ½" thick with an even, clear wear surface of 10–20 mils having a decorative image thereon.

It is an object of the present invention to provide synthetic composite panel for floors, walls or the like which is strong, long wearing and has a high impact resistance.

It is another object of the present invention to provide a composite panel which is not susceptible to deleterious thermal expansion, moisture absorption and deterioration.

It is another object of the present invention to provide an impact and wear resistant composite panel of the type described above wherein the composite panel is comprised of glass fibers in a thermosetting resin matrix including a printed graphic.

A still further object of the present invention is to provide a composite panel as described above having a natural wood grain appearance.

A still further object is to provide a floor composite of approximately ½ inch thickness without warping.

These and other objects will be apparent from the description to follow and from the appended claims.

DETAILED DESCRIPTION OF PREFERRED EMBODIMENT

Broadly stated, the present invention pertains to a decorative surface panel of synthetic material comprised of a plurality of layers of glass mats, which layers are impregnated with thermosetting resin to form a laminate composite. The panel composite can best be described as comprised of two regions, an upper overlay/graphic region and a lower, relatively thick, reinforced base region. The upper region is comprised of an outer wear coat or overlay and a printed graphic sheet, conventionally known as a "prepreg", which conveys a decorative effect, such as of wood grain, to the panel. This region is formed by impregnating the graphic print sheet with a thermosetting polyester resin. The overlay or wear coat is a layer of thin, preferably clear thermosetting polyester resin having a thickness of approximately 10–20 mils. In the preferred embodiment, a thin veil of relatively thin glass fibers having a high fiber density is embedded in the wear coat. The veil is approximately 20 mils thick and imparts added strength and impact resistance to the wear coat, and, as will be described later, assists in balancing the internal stresses in the panel composite during forming. The overall thickness of the overlay/graphic region is approximately 10–20 mils wherein the impregnated print is approximately 3–4 mils thick and the overlay with glass veil is approximately 10–15 mils thick. The resin used in this upper region of the panel composite is preferably comprised of a thermosetting unsaturated polyester polymer comprised of 0.0 to 0.2 moles of dipropylene glycol, 0.8 to 1.0 moles of ethylene glycol, 0.1 to 0.5 moles of maleic anhydride, and 0.2 to 0.5 moles of isophthalic acid dissolved in up to 45 percent by weight low viscosity unsaturated monomer like styrene or vinyl toluene.

Referring now to the lower reinforced base region of the panel composite, this region is generally comprised of several layers of glass mat impregnated with a thermosetting polyester resin inorganic mineral filler mix. More specifically, the upper layer of this region which is immediately below the prepreg print sheet is preferably a thin fiber/high density glass mat. Below this thin fiber/high density mat are a plurality of layers of coarser, thick fiber/low density glass mat which comprise the core of the lower reinforced base portion of the panel composite. In the preferred embodiment, six to ten layers of thick fiber/low density glass mat are used, which mats form the structural matrix giving the panel composite its strength. Below these core layers of thick fiber/low density glass mats are two layers of thin fiber/high density glass mat which comprise the bottommost layers of the overall composite.

The arrangement and position of the glass mats in the lower base regions of the composite are important in several respects. The thin fiber/high density glass mat positioned between the prepreg print sheet and the core mat layers is provided to prevent telegraphing or transmission of the coarse texture of the thick fiber/low density core mats to the surface of the print sheet. In this respect, the thick fiber/low density glass mats forming the core of the composite are comprised of loosely intertwined or tangled strands having coarse surfaces which would show through the thin, flat graphic sheet if disposed immediately adjacent thereto. This intermediate layer of thin fiber/high density glass mat prevents the coarse texture of the upper core mat from bleeding through the prepreg sheet, wherein a smooth graphic layer and image are maintained near the surface of the composite. With respect to the bottom two layers of thin fiber/high density glass mat below the core mats, it has been found in the forming of thick multi-layer composite structures having layers of mats of dissimilar density and weight, that internal residual forces build up within the laminate upon curing. These residual forces can warp or bow the resulting structure. The lowermost sheets of thin fiber/high density mat act to balance the composite structure. In other words, these lowermost sheets counter-balance the internal stresses created by the veil and print sheet at the uppermost portion of the composite. As set forth above, the reinforcing portion of the floor composite is formed from a plurality of glass mat sheets impregnated by a thermosetting polyester resin inorganic mineral filler mix. In the present embodiment, the resin is preferably comprised of a thermosetting unsaturated polyester polymer comprised of 0.0 to 0.5 moles of propylene glycol, 0.5 to 1.0 moles of ethylene glycol, 0.2 to 0.5 moles of maleic anhydride, and 0.3 to 0.5 moles of dicyclopentadiene dissolved in up to 50 percent by weight of low viscosity unsaturated monomer like styrene or vinyl toluene. Inorganic mineral fillers which may be used are trihydride of alumina, kolin, talc, and calcium carbonate.

It will of course be appreciated that the resulting floor composite can be modified depending on the type of resin used with respect to the overlay/graphic region and the reinforced base region of the composite. The floor composite has been described with respect to an upper overlay/graphic region and a lower reinforced base region. As will be appreciated, these portions are not separate but rather form an integral unit.

Referring now to the method of forming the panel composite described heretofore, the prepreg or print graphic sheet is impregnated with a resin of the type described above. The thin fiber/high density glass veil is applied to the surface of the prepreg printed sheet and impregnated with resin to form the overlay wear coat.

Independent of the preparation of the overlay/graphic region, the respective layers of the reinforced base region of the composite are arranged in a tray, container or the like and wetted, i.e., impregnated or saturated, with a resin of the type described above. The tray containing the glass mats forming this lower reinforced base portion of the composite are placed in a press conventionally known in the art. At this point, the overlay/graphic layer which is still tacky, is placed in position on top of the layers of mat impregnated with resin. The press is closed and the layers are compressed between two generally planar plates, the upper plate preferably polished to provide a smooth glossy finish to the floor composite. The layers are compressed under approximately 500 psi at 220° F. for approximately 9 minutes to cure the resin. The resulting composite is approximately ½" thick having a wear surface of 10–20 mils and a graphic or print layer of approximately 3–4 mils. As will be appreciated, the overall height of the resulting floor composite is reduced from its original wetted condition as a result of the pressing and molding procedure.

A panel according to the present invention finds advantageous application as a floor or wall member. The composite may be secured to any planar surface, i.e., existing floor or wall, or more importantly can be secured directly to floor joists or wall studs wherein the composite panel is the load bearing member. In this respect, a composite according to the present invention is extremely strong due to the fiber glass in resin matrix. In addition, the image depicted on the graphic print sheet can be selected to duplicate a desired building material, such as natural wood grain, marble or slate.

The invention has been described as comprised of a certain and type number of glass mats arranged in a selected type of resin. It will be appreciated that the type of glass, as well as the number of mats and their density, may vary depending on the strength and wear characteristics desired in the panel composite. Other uses and additional modifications and alteration will occur to others upon the reading and understanding of this specification. It is intended that all such modifications and alterations be included insofar as they come within the scope of the invention as claimed or the equivalents thereof.

Having thus described the invention, it is claimed:

1. A synthetic composite panel comprising:

a reinforced base portion comprised of a plurality of layers of glass mat impregnated with a polyester resin, said layers of glass mat including at least one thick fiber/low density glass mat and at least one thin fiber/high density glass mat;

an overlying polyester resin-impregnated graphic print sheet; and a transparent polyester resin overlay, said layers of glass mat disposed within said base portion in predetermined positions to balance the residual stresses within said panel during the setting of said resins.

2. A composite panel as defined in claim 1 wherein said layers of glass mat of said base portion include a plurality of thick fiber/low density glass mats disposed between layers of thin fiber/high density glass mats.

3. A composite panel as defined in claim 2 wherein said thick fiber/low density glass mat is formed from glass having low soda, high boron content.

4. A composite panel as defined in claim 2 wherein said base portion includes, from top to bottom, a layer of thin fiber/high density mat, a plurality of layers of thick fiber/low density glass mat, and 2 layers of thin fiber/high density mat.

5. A composite panel as defined in claim 1 wherein said resin includes dipropylene glycol, ethylene glycol and maleic anhydride.

6. A composite panel as defined in claim 1 wherein said resin overlay is a thermosetting unsaturated polyester polymer comprised of:

0.0 to 0.2 moles of dipropylene glycol;

0.8 to 1.0 moles of ethylene glycol;

0.1 to 0.5 moles of maleic anhydride; and, 0.2 to 0.5 moles of isophthalic acid dissolved in up to 45% by weight low viscosity unsaturated monomer.

7. A composite panel as defined in claim 1 wherein said resin in said reinforced base portion is comprised of:

0.0 to 0.5 moles propylene glycol;

0.5 to 1.0 moles of ethylene glycol;

0.2 to 0.5 moles of maleic anhydride; and, 0.3 to 0.5 moles of dicyclopentadiene dissolved in up to 50% by weight low viscosity unsaturated monomer.

8. A composite panel as defined in claim 5 wherein said resin in said reinforced base portion includes an inorganic mineral filler.

9. A composite panel as defined in claim 4 or 5 wherein said low viscosity unsaturated monomer in said resins in said overlay and said reinforced base portion is styrene or vinyl toluene.

10. A composite panel as defined in claim 1 wherein said overlay includes a glass veil of thin fiber/high density glass mat.

11. A composite panel as defined in claim 1 wherein the thickness of said flooring is approximately ½ inch, wherein said graphic print sheet is approximately 3–4 mils thick and said overlay is approximately 10–20 mils thick.

12. A composite panel as defined in claim 1 wherein the glass mat in said reinforced base portion immediately below said graphic print sheet is a thin fiber/high density glass mat.

13. A method of forming a composite panel, comprising the steps of:

(a) impregnating a graphic print sheet with an unsaturated polyester resin;

(b) overlaying said sheet with a thin fiber/high density fiber glass veil impregnated with an unsaturated polyester resin to form a laminate;

(c) overlaying said laminate on a plurality of glass mats impregnated with a polyester resin, said plurality of glass mats including thick fiber/low density glass mats and thin fiber/high density glass mats wherein at least one thick fiber/low density glass mat is disposed between layers of thin fiber/-high density glass mats and the layer immediately below said graphic sheet is a thin fiber/high density glass mat; and, (d) curing said laminate and impregnated mats under pressure.

14. A method as defined in claim 13 wherein said unsaturated polyester resin impregnating said graphic print and said glass veil is comprised of dipropylene glycol, ethylene glycol, maleic anhydride and isophthalic acid dissolved in an unsaturated monomer.

15. A method as defined in claim 14 wherein said plurality of glass mats includes a plurality of thick fiber/low density mats forming the core of said panel.

16. A method as defined in claim 13 wherein said resin impregnating said plurality of glass mats includes propylene glycol, ethylene glycol, maleic anhydride and dicyclopentadiene dissolved in a low viscosity unsaturated monomer.

17. A method as defined in claim 16 wherein said resin impregnating said plurality of glass mats includes an inorganic mineral filler.

18. A method as defined in claim 17 wherein said inorganic mineral filler is kaolin, or talc, or calcium carbonate, or trihydride of alumina.

19. A method as defined in claim 13 wherein said step of curing said laminate comprised heating said laminates and mats under pressure to approximately 220° F. for approximately 9 minutes.

20. A method as defined in claim 19 wherein said pressure is approximately 500 psi.

* * * * *